US009452395B2

(12) United States Patent
Jeronimo et al.

(10) Patent No.: US 9,452,395 B2
(45) Date of Patent: Sep. 27, 2016

(54) WATER-SOLUBLE POLYMER DISPERSION APPLIANCE

(75) Inventors: Philippe Jeronimo, Montrond les Bains (FR); Emmanuel Pich, Saint Priest en Jarez (FR); Eric Denjean, Dardilly, legal representative (FR)

(73) Assignee: S.P.C.M. SA (FR)

( * ) Notice: Subject to any disclaimer, the term of this patent is extended or adjusted under 35 U.S.C. 154(b) by 1027 days.

(21) Appl. No.: 13/575,962

(22) PCT Filed: Feb. 8, 2011

(86) PCT No.: PCT/FR2011/050262

§ 371 (c)(1),
(2), (4) Date: Nov. 13, 2012

(87) PCT Pub. No.: WO2011/107683

PCT Pub. Date: Sep. 9, 2011

(65) Prior Publication Data

US 2015/0352507 A1 Dec. 10, 2015

(30) Foreign Application Priority Data

Feb. 16, 2010 (FR) ..... 10 51099

(51) Int. Cl.
*B01F 7/00* (2006.01)
*B01F 15/02* (2006.01)
(Continued)

(52) U.S. Cl.
CPC ..... *B01F 7/0025* (2013.01); *B01F 1/0011* (2013.01); *B01F 3/1221* (2013.01);
(Continued)

(58) Field of Classification Search
CPC B01F 7/0025; B01F 15/0254; B01F 1/0011; B01F 7/00541; B01F 15/00188; B01F 2215/0049; C22C 38/001; C22C 38/44; B02C 18/2225; B02C 18/086
USPC ..... 366/183.1, 315, 316, 303, 304, 306, 366/317, 307; 241/41, 62, 242, 244, 257.1, 241/260, 296
See application file for complete search history.

(56) References Cited

U.S. PATENT DOCUMENTS 4,203,556 A * 5/1980 Krysiak ..... B02C 18/148 241/244
4,529,794 A * 7/1985 Sortwell ..... B01F 1/0011 528/499

(Continued)

FOREIGN PATENT DOCUMENTS

FR 955555 A 1/1950
FR 2777804 A 10/1999

(Continued)

OTHER PUBLICATIONS

Avesta: "Avesta Sheffield SAF 2507", ASM Materials Information, Sep. 1, 1996, XP002603868, 2 pages.

*Primary Examiner* — Faye Francis
*Assistant Examiner* — Onekki Jolly
(74) *Attorney, Agent, or Firm* — St. Onge Steward Johnston & Reens, LLC

(57) ABSTRACT

Device for dispersing a water-soluble polymer including a rotor equipped with knives, a fixed stator, over all or part of the periphery of the chamber, a ring fed by a secondary water circuit, characterised in that the rotor knives and the stator are made out of austeno-ferritic stainless steel and in that the stator comes in the form of a cylinder in the wall of which are cut vertical slits produced on part of the height of the wall, the slits having a width of between 150 and 700 micrometers.

9 Claims, 4 Drawing Sheets

(51) Int. Cl.

| | |
|---|---|
| ***B02C 18/06*** | (2006.01) |
| ***B01F 15/00*** | (2006.01) |
| ***B02C 18/08*** | (2006.01) |
| ***B02C 18/22*** | (2006.01) |
| ***B01F 1/00*** | (2006.01) |
| ***B01F 3/12*** | (2006.01) |
| ***B01F 5/24*** | (2006.01) |
| ***B01F 7/16*** | (2006.01) |
| ***C22C 38/00*** | (2006.01) |
| ***C22C 38/42*** | (2006.01) |
| ***C22C 38/44*** | (2006.01) |
| ***C23C 8/22*** | (2006.01) |
| ***C23C 8/26*** | (2006.01) |

(52) U.S. Cl.

CPC ..... *B01F3/1228* (2013.01); *B01F 5/248* (2013.01); *B01F 7/00025* (2013.01); *B01F 7/00033* (2013.01); *B01F 7/00541* (2013.01); *B01F 7/164* (2013.01); *B01F 15/00188* (2013.01); *B01F 15/0254* (2013.01); *B02C 18/086* (2013.01); *B02C 18/2225* (2013.01); *C22C 38/001* (2013.01); *C22C 38/42* (2013.01); *C22C 38/44* (2013.01); *C23C 8/22* (2013.01); *C23C 8/26* (2013.01); *B01F 2215/0049* (2013.01); *B01F 2215/0427* (2013.01); *B01F 2215/0431* (2013.01)

(56) References Cited

U.S. PATENT DOCUMENTS

| | | | | |
|---|---|---|---|---|
| 4,640,622 | A * | 2/1987 | Sortwell | B01F 5/248 366/156.1 |
| 5,018,871 | A * | 5/1991 | Brazelton | B01F 7/163 366/169.1 |
| 5,156,344 | A | 10/1992 | Tippett | |
| 5,599,102 | A * | 2/1997 | Hamada | B01F 5/226 241/46.017 |
| 6,000,840 | A | 12/1999 | Paterson | |
| 6,045,070 | A * | 4/2000 | Davenport | B02C 7/04 175/206 |
| 7,048,432 | B2 * | 5/2006 | Phillippi | B01F 3/1221 366/164.1 |
| 7,461,970 | B2 * | 12/2008 | Brown | B01F 15/0267 241/199.12 |
| 2006/0028914 | A1 * | 2/2006 | Phillippi | B01F 3/1221 366/279 |

FOREIGN PATENT DOCUMENTS

| | | | |
|---|---|---|---|
| WO | 2008107492 | A1 | 9/2008 |
| WO | 2010020698 | A2 | 2/2010 |

* cited by examiner

WATER-SOLUBLE POLYMER DISPERSION APPLIANCE

Polyacrylamides have been developed over more than 60 years specifically for flocculation operations. However since the oil crisis of 1973, polyacrylamides have been recognised as having very considerable viscosifying power enabling them to be used in Enhanced Oil Recovery on their own or in combination with surfactants and alkalis.

It was also noted that polyacrylamides had the power to reduce friction in water or aqueous solution, a characteristic which means that greater volumes of water can be pumped in the same equipment, by adding a small quantity (30 to 500 ppm) of polymer, or that the power consumed in pumping same quantities can be reduced.

Friction reduction was discovered by B. A. Toms in 1946 ("Toms' effect") and its uses have been developed in the field of transporting water or aqueous suspensions (water-oil mix), in fracturing operations, and various water-contact processes involving high power consumption (torpedoes, fire-fighting, water-jet cutout, etc.)

Dissolving Polyacrylamides

Although it is possible to use polyacrylamides in powder form for operations to reduce friction, dissolving them is relatively difficult. For standard powders with a particle size distribution below 1 mm the dissolving time is about one hour at a concentration of 5 grams per litre. It would therefore be necessary for significant uses to have available large-scale equipment requiring at one and the same time:

A significant investment,

A long commissioning time,

A ground area incompatible with moving the equipment.

This need to have a practically instantaneous solution (less than 2 minutes for example) has led users to switch to using polyacrylamides in emulsion form which are able to dissolve, in appropriate conditions, in under 2 minutes (see patent application FR 0955555). However environmental requirements, particularly in hydraulic fracturing operations, are causing emulsions that contain hydrocarbons and surfactants to be replaced by polymers in powder form that do not contain such components.

The Applicant's document PCT/EP2009/063961 describes a hydraulic fracturing method that employs a piece of equipment for quickly dissolving water-soluble powder polymer known as a "PSU", the equipment being described in the document WO 2008/107492 also by the Applicant.

By grinding the polyacrylamide in a PSU of this kind, it is possible to cut the dissolving time to about 15 minutes, at concentrations of between 10 and 20 grams per litre. Moreover the compact nature of the facility allows it to be employed on mobile truck frames.

PSU (Polymer Slicing Unit)

The PSU described in the patent application WO 2008/107492 is a piece of industrial equipment that rotates at a low industrial speed (3,000 to 4,500 revs per minute) thereby offering considerable longevity especially in oil or fracturing operations.

Equipment reliability is a major point. For example stopping the introduction of polymers in a fracturing operation may cause the gas production well to block by settling of the sand used.

The PSU basically comprises:

- a cone for wetting the powder polymer, connected to a primary water inlet circuit,
- a chamber for grinding the dispersed polymer, including a rotor associated with a stator,

- on the periphery of the chamber, a ring fed by a secondary water circuit that sprays pressurised water and unclogs the blades of the stator.

The stator comprises customised tungsten carbide plates or blades assembled by means of spacers on a peripheral ring.

Patent documents U.S. Pat. Nos. 6,000,840, 5,156,344 and FR 2777804 A1 disclose a stator ring comprising a plurality of openings. The stator ring of U.S. Pat. No. 5,156,344 is surrounded with a restrictor comprising the same amount of openings as the main stator ring. The position of this restrictor may be adjusted so as to fully open or close the openings of the stator ring. Neither of these documents mentions the width of the openings.

The rotor includes tungsten carbide plates bolted or brazed so as to reduce wear and tear during these operations.

Although this system is mechanically effective, it has two limitations:

- it is difficult to bring the plates of the stator to less than 500 microns from each other since the very slender spacers do not have the requisite mechanical strength,
- the bonding material (cobalt or nickel) does not have sufficient corrosion resistance particularly in the oil industry where the pumped brines contain very large quantities of salts (up to 200,000 ppm) and hydrogen sulphide.

The problem the invention sets out to resolve is therefore that of improving the construction of the PSU thereby allowing:

- finer grinding with practically instantaneous use of the polymer solution like that obtained with emulsions,
- greater corrosion resistance,
- while maintaining the shelf life of the stator and rotor,
- the use of the equipment for many polymers such as polyacrylamide, high molecular weight polyethylene oxide, xanthan gum or sclerogucan, guar gum, etc.

The Applicant has noted that these 4 objectives were met by using, for the manufacture of the rotor and stator, stainless steels, and particularly so-called "super duplex" austeno-ferritic steels or austenitic steels that have been surface-hardened (vacuum nitriding, kolsterisation) and have high mechanical strength and strong corrosion resistance in combination with the use, in the stator, not of customised blades but of slits produced directly on a ring.

In other words, the object of the invention is a device for dispersing a water-soluble polymer with a standard particle-size distribution below 1 mm comprising:

- a wetting cone in which the polymer is metered, said cone being connected to a primary water inlet circuit,
- at the bottom end of the cone:
  - a chamber for grinding and draining of the dispersed polymer comprising:
    - a rotor driven by a motor and equipped with knives optionally tilted with respect to the rotor radius,
    - a stator,
  - over all or part of the periphery of the chamber, a ring fed by a secondary water circuit, the ring communicating with the chamber for the spraying of pressurised water onto the stator.

The device is characterised in that the rotor knives at least partially, and the stator, are made out of stainless steel selected from among austeno-ferritic or austenitic steels and treated by vacuum nitriding or by carbon diffusion and in that the stator comes in the form of a cylinder in the wall of which are arranged vertical slits produced on part of the height of said wall, the slits having a minimum width of 150 micrometres, and to advantage between 150 and 700 micrometers.

In a preferred embodiment, the slits are between 10 and 50 mm in height and are located equidistant from the upper and lower edges of the cylinder. Where a great height of slit is involved, these will be cut in 2, 3 or 4 parts.

According to another characteristic, the slits are spaced out evenly from each other by a distance of between 10 and 50 mm. In a particular embodiment, the internal walls of the slits are inclined so as to create cutting edges on each slit.

According to the invention, the rotor and stator may be made out of different materials.

In a first embodiment, they are made out of vacuum-nitrided austenitic stainless steel 304L or 316L but with performance and longevity rates below the austeno-ferritic steels.

In a preferred embodiment, they are made, out of austeno-ferritic steel containing at least 20% by weight of Cr and at least 5% by weight of Ni.

Among the austeno-ferritic steels can be distinguished the so-called "duplex" steels containing about 22% by weight of Cr and about 5% by weight of Ni and the so-called "super duplex" steels containing between 24 and 26% by weight of Cr and from 6 to 8% by weight of Ni.

According to one improved embodiment, the austeno-ferritic steels are kolsterised, in other words treated by carbon diffusion as explained below.

To advantage, the austeno-ferritic steel selected has one of the following two compositions:

| | % C | % Cr | % Mo | % Ni | % N | % W | % Cu |
|---|---|---|---|---|---|---|---|
| Composition 1 (UNS S32750) | Max 0.03 | 24-26 | 3.0-5.0 | 6.0-8.0 | 0.24-0.32 | | 0.5 |
| Composition 2 (UNS S32760) | Max 0.03 | 24-26 | 3.0-4.0 | 6.0-8.0 | 0.20-0.30 | 0.5-0.1 | 0.5-0.1 |

The mechanical properties of these steels are far superior to 304L or 316L stainless steels and are as follows:

| | Rp 0.2 (MPA) | Rm (MPA) | $A_3$ (%) |
|---|---|---|---|
| Composition 1 (UNS S32750) | ≥550 | ≥795 | ≥15 |
| Composition 2 (UNS S32760) | ≥550 | ≥750 | ≥25 |

Rp 0.2 (MPA) 0.2% Yield strength (MPA) min
Rm (MPA) Tensile strength (MPA) min
$A_3$ elongation % min Tungsten carbide has mechanical characteristics superior to those of super duplex grades, but those of super duplex grades are sufficiently high relative to the hardness of the polyacrylamide grain to allow great longevity of the rotors and stators.

Moreover, after machining, the super duplex or duplex may be treated so as to increase the surface hardness by kolsterising over a thickness of 20 to 30 microns without damaging the corrosion resistance and without altering the geometry of the parts and reach Rm of more than 1000.

Kolsterisation® treatment is a method for the surface modification of the structure of stainless steels. It comprises diffusing a large quantity of carbon from the surface towards the core of the material, with no addition of external elements and without manufacturing chromium carbide. This treatment is applied in gaseous phase and at low temperature and can be used to treat any shape including slits such as those in PSUs. This treatment is effective up to temperatures of 300° C. and pH above 2. This method allows fatigue resistance and corrosion resistance, the elimination of seizing, very high rates of hardness while maintaining non-magnetism.

It is quite clear that super duplex is the most resistant material, but it is possible, as has already been said, to use Duplex steels with 20% Chromium or standard vacuum-nitrided 304L or 316L stainless steels but with inferior performance and longevity rates.

As has already been said, PSU construction is difficult with plate gaps of less than 500 microns, it was necessary to use another technology for very fine grinding of the polymer. For the stator, a choice was made to use a ring or cylinder of the same internal diameter as the PSU on which slits are cut with a latest generation water jet cut capable of forming slits with a minimum width of 150 microns with a unitary jet and of any other width with a dual jet. This stator must have a high level of rigidity and it is to advantage from at least 10 mm up to 20 mm thick so as not to lose the accuracy of cut. It is moreover possible with high precision water jet equipment to make conical cuts that allow better ejection of the ground polymer.

In practice, the cut is made using a cutting machine with a very high pressure water jet containing an abrasive, at a pressure of between 2,000 and 5,000 bars, and preferably between 3,000 and 4.000 bars.

A smaller thickness is obviously possible but causes distortions and fractures in the medium term, particularly as a function of the unavoidable fretting caused by grinding the polymer.

Cutting can also be performed by laser but over small thicknesses, but the thermal effect creates permanent distortions and rough patches on the slits so cut, making it compulsory to refill the part after cutting.

The number of slits in the stator varies according to its diameter. In practice, it is between 50 and 300.

According to one basic inventive characteristic, the rotor knives are at least partially made out of vacuum-treated or kolsterised austeno-ferritic or austenitic stainless steel.

In a first embodiment, the rotor comprises a carrier on the surface of which the knives are formed by milling. In this case, the rotor is made in its entirety out of one of the aforementioned materials.

In a second embodiment, the rotor comprises a machined carrier made out of one of the previously described materials to which are added plates made of tungsten carbide, or stainless steel hardened by heat treatment.

In both cases, maintenance can be applied to recover the rotor-stator distances by machining the inside of the stator to a larger diameter. As far as the rotor is concerned it is possible to:

Either change the plates to adapt to the new diameter,

Or weld load the solid rotor which is then rotated to give the required cut diameter.

The rotor is fitted with between 2 and 20 knives, and to advantage between 4 and 12. Nonetheless, depending on the rotor diameter, the number of knives may vary. As an example, it is 9 for a rotor diameter of 200 mm.

Furthermore and according to another characteristic, the knives may be more or less inclined relative to the rotor radius. To advantage, this inclination is between 1 and 15°, and preferably between 2 and 10°.

To allow effective grinding, the distance separating the rotor knives from the stator blades is between 50 and 300 microns, and preferably between 100 and 200 microns, in practice about 100 microns.

Obviously, reducing the width of the slits reduces the outflow of powder and water of each appliance which can be partly restored by increasing the rotor speed up to the industrial limit of 4,500 revs per minute.

As already mentioned, the stator design allows the polymer to be ground more finely relative to the device described in the document WO 2008/107492 in which the space between each customised blade could not, in practice, be less than 500 micrometres without a very significant reduction in appliance longevity.

In other words, a further object of the invention is the use of the inventive dissolving device in a facility for implementation of an oil or gas well hydraulic fracturing method, Enhanced Oil Recovery, flocculation, preparation of cosmetic solutions or household products. It further makes it possible to reduce significantly the number of parts to be machined and the complexity of the assembly.

For all these methods, even if dissolution is not complete at injection, it may occur in the few tens of seconds after injection either directly in the pipeline, or in the Mixture to be treated.

The invention and resulting advantages thereof will become clearer from the following examples supported by the appended figures.

Figure 1:
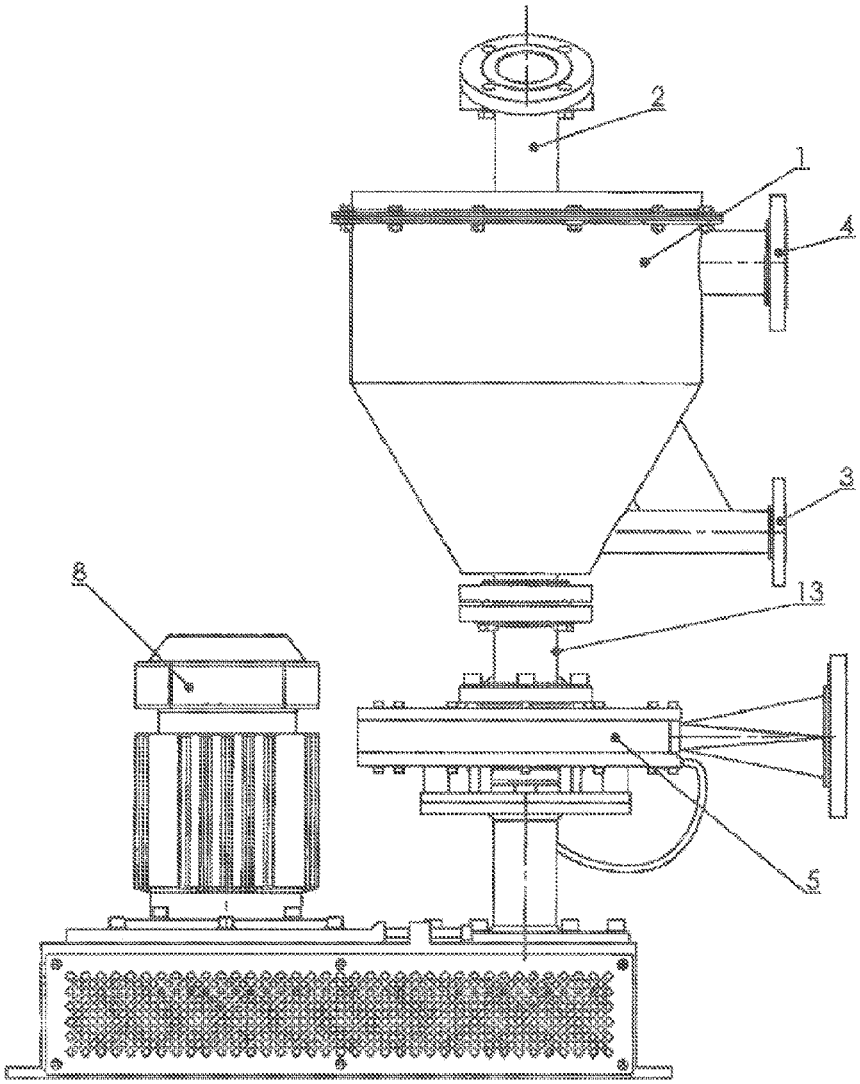
FIG. 1 is a schematic side view of the inventive device.
Figure 2:
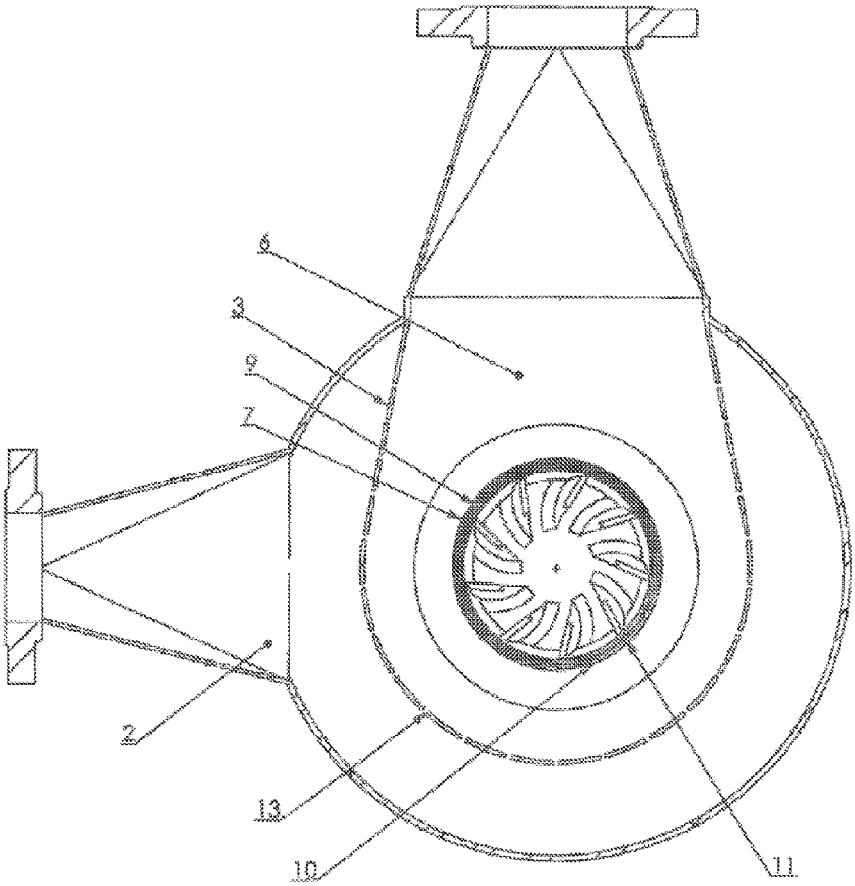
FIG. 2 is a cross-section view along the line AA'.

In accordance with FIG. 1, the inventive device comprises:

- a wetting cone (1) connected on its top to a column (2) measuring out the polymer of standard particle size distribution, more often than not by means of a dosing screw, the cone (1) being connected in its bottom to a primary water inlet circuit (3) which feeds an overflow (4).
- at the bottom end of the cone, an assembly (5) comprising:
  - a chamber for grinding and draining (6) (FIG. 2) of the dispersed polymer comprising:
    - a rotor (7) driven by a motor (8) equipped with knives (9),
    - a stator (10),
  - over all or part of the periphery of the chamber, a ring (11) fed by a secondary water circuit (12), the ring (11) communicating with the chamber (6) via slits (13) for spraying pressurised water onto the stator (10).

Figure 3C:
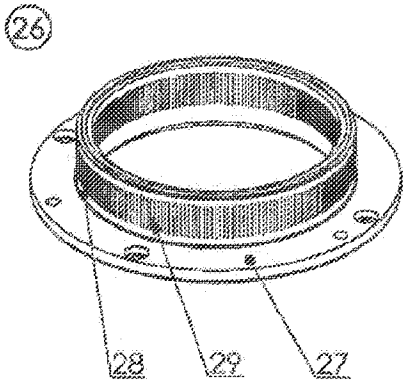
FIG. 3A is a view of the inventive device rotor in accordance with a first embodiment.
FIG. 3B is a view of the inventive device rotor in accordance with a second embodiment.
Figure 3C:
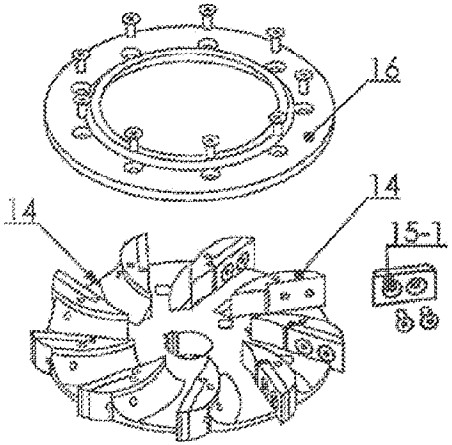
Figure 3D:
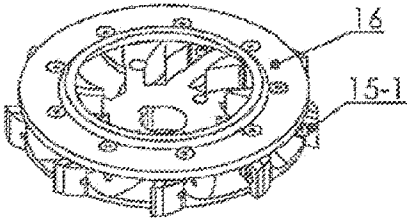
Figure 3A:
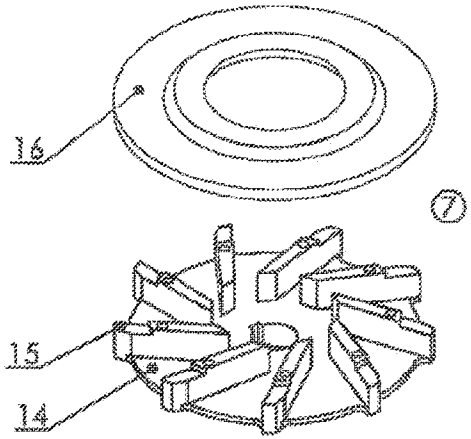
Figure 3B:
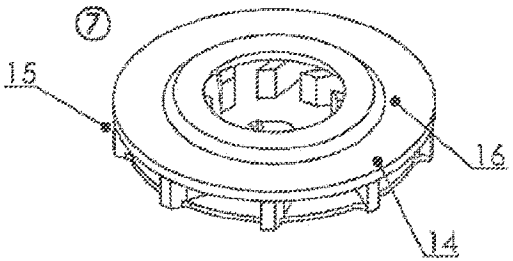

In FIGS. 3A-3D, the inventive device rotor has been shown. FIG. 3A is an exploded view of the rotor denoted by the general reference (7), whereas FIG. 3B is a view of the finished part.

The rotor includes a corrosion-resistant composite carrier disk (14) on which are milled 9 inclined knives (15) made of super duplex with the following composition:

| | % C | % Cr | % Mo | % Ni | % N | % W | % Cu |
|---|---|---|---|---|---|---|---|
| UNS S32750 | Max 0.03 | 24-26 | 3.0-5.0 | 6.0-8.0 | 0.24-0.32 | | 0.5 |

The knives (15) are protected by a hush (16) added to the upper part thereof.

In FIGS. 3A and 3B, an alternative rotor construction has been shown. It then includes a machined rotary carrier (14) made of stainless steel (super duplex, 304, 316) to which are secured plates (15-1) made of tungsten carbide or stainless steel hardened by heat treatment.

Figure 4A:
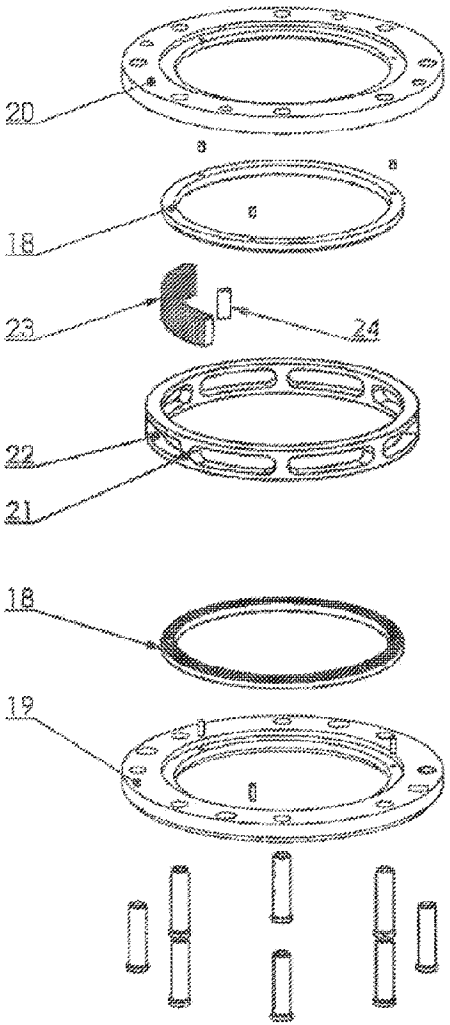
FIGS. 4A and 4B are a view of the inventive device stator described in the document WO 2008/107492.
Figure 4B:
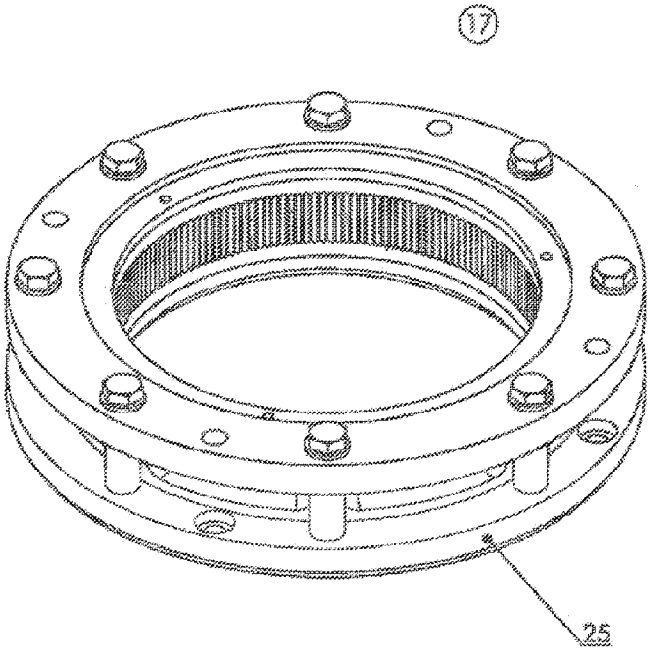

In FIGS. 4A and 4B, the stator has been shown as it is implemented in the PSUs described in the document WO 2008/107492, now commercially available. As is shown in FIG. 4*a*, the stator (17) is fitted, apart from the gaskets (18) with basically 4 elements respectively:

- a lower bush (19),
- an upper bush (20),
- a slotted central ring (21) supporting the plates (22),
- the stator as such (23) consisting of customised blades (24) made of tungsten carbide, separated by spacers, milted on the part (18) and not shown.

The bushes (19) and (20) are associated with each other so that, in combination with the part (21), the blades (24) can be kept in position.

Figure 5:
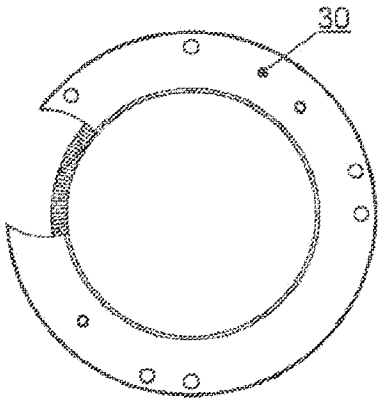
FIG. 5 is a view of the stator according to the inventive device.

In FIG. 5 has been shown the stator in accordance with that of the invention. This stator, denoted by the general reference (26), comprises a single part (27) of thickness equal to 10 mm provided with slits (29) made with a unitary water jet at very high pressure (3000 to 4000 bars). The width of each of the slits is 200 microns. As is shown in the figure, the slits are distributed equidistant from the upper and lower edges of the cylinder (28). The distance separating each slit is 300 microns.

The part (27) is made in accordance with the invention out of super duplex with the following composition:

| | % C | % Cr | % Mo | % Ni | % N | % W | % Cu |
|---|---|---|---|---|---|---|---|
| UNS S32750 | Max 0.03 | 24-26 | 3.0-5.0 | 6.0-8.0 | 0.24-0.32 | | 0.5 |

All dimensional characteristics of the rotor and stator of the prior art PSU and of the inventive PSU, as well as the operating characteristics that allow the polymer to dissolve are given in the following table:

TABLE 1

| | PSU 300 according to the document WO2008/107492 | PSU 300 according to the invention |
|---|---|---|
| Diameter of cut (mm) | 200 | 200 |
| Number of fixed blades (stator) | 90 | |
| Height of fixed blades (mm) (stator) | 16.6 | |
| Space between blades (microns) (stator) | 500 | |
| Number of slits | | 110 |
| Height of slits (mm) | | 16.6 |
| Width of slits (micron) | | 200 |

TABLE 1-continued

| | PSU 300 according to the document WO2008/107492 | PSU 300 according to the invention |
|---|---|---|
| Number of mobile knives (rotor) | 9 | 9 |
| Engine power (KW) | 7.5 | 7.5 |
| Rotor speed (t/min) | 3000 | 4500 |
| Maximum primary water outflow ($m^3$/h) | 20 | 15 |
| Max powder outflow at 10 $m^3$/h (kg) | 650 | 470 |
| Secondary water throughput ($m^3$/h) | 20 | 20 |
| Industrial throughput of facility | | |
| Primary water ($m^3$/h) | 10 | 10 |
| Secondary water ($m^3$/h) | 20 | 20 |
| Powder (kg/h) | 300 | 300 |
| Dissolution concentration (g/l) | 10 | 10 |
| Dissolving time at 40° C./Minute | 10 | 1 |

It is therefore incidentally possible with such equipment for the dissolving tanks normally required to dissolve powder form polyacrylamides to be eliminated and for the polymer to be injected directly.

In particular, in fracturing operations, the polymers are mixed in a blender for a period comprised between 1 and 2 minutes, picked up by a centrifugal pump to supply the Triplex pump which injects the fracturing mix. The mixing times are sufficient to allow such an operation on line.

The size of the appliances using this technology may be modular (100, 300, 600, 1200 kg/hour). This type of equipment may obviously be used:

For polymers of different compositions such as high molecular weight polyethylene oxides, xanthan gums or sclerogucan, guar gums etc.

For other Uses like flocculation with on-line dissolution, Enhanced Oil Recovery, making up cosmetic solutions or household products.

With powders of miscellaneous particle size distributions preventing fish eyes from forming on dispersion.

The invention claimed is:

1. A device for dispersing a water-soluble polymer with a standard particle size distribution below 1 mm comprising:

a wetting cone in which the polymer is metered, said cone being connected to a primary water inlet circuit, an assembly disposed at the bottom end of said cone, said assembly comprising:

a chamber for grinding and draining of the dispersed polymer comprising:

a rotor driven by a motor and equipped with knives, a fixed stator, and a ring disposed around at least part of a periphery of the chamber, the ring fed by a secondary water circuit and communicating with the chamber to ensure that pressurised water is sprayed onto the stator, characterised in that the rotor knives at least partially, and the stator are made out of a stainless steel selected from among the austeno-ferritic or austenitic steels and treated by vacuum nitriding or by carbon diffusion and further characterised in that the stator comprises a cylinder in a wall of which are cut vertical slits made over part of the height of said wall, the slits having a width of between 150 and 700 micrometers.

2. The device as claimed in claim 1, characterised in that the stator is cut by cutting with a very high pressure water jet containing an abrasive, at a pressure of between 2,000 and 5,000 bars.

3. The device as claimed in claim 1, characterised in that the austeno-ferritic stainless steel contains about 22% by weight of Cr and about 5% by weight of Ni.

4. The device as claimed in claim 1, characterised in that the austeno-ferritic stainless steel has one of the two following compositions:

| | % C | % Cr | % Mo | % Ni | % N | % W | % Cu |
|---|---|---|---|---|---|---|---|
| UNS S32750 | Max 0.03 | 24-26 | 3.0-5.0 | 6.0-8.0 | 0.24-0.32 | | 0.5 |
| UNS S32760 | Max 0.03. | 24-26 | 3.0-4.0 | 6.0-8.0 | 0.20-0.30 | 0.5-0.1 | 0.5-0.1 |

5. The device as claimed in claim 1, characterised in that the rotor knives and the stator are further treated by carbon diffusion from the surface towards the core of the material.

6. The device as claimed in claim 1, characterised in that the rotor comprises a carrier on the surface of which the knives are formed by milling, the carrier and the knives being made out of said stainless steel.

7. The device as claimed in claim 1, characterised in that the rotor comprises a machined carrier made out of austeno-ferritic or austenitic steel treated by vacuum nitriding or by carbon diffusion to which are added plates made out of tungsten carbide or stainless steel hardened by heat treatment.

8. The device as claimed in claim 1, characterised in that the slits in the stator are evenly spaced apart from each other by a distance of between 10 and 50 mm.

9. The device as claimed in claim 1, characterised in that the distance separating the rotor knives from the slits in the stator is between 50 and 300 microns.

* * * * *